US006712031B2

(12) United States Patent
Harada et al.

(10) Patent No.: US 6,712,031 B2
(45) Date of Patent: Mar. 30, 2004

(54) SUPPORT DEVICE FOR ROCKER ARM

(75) Inventors: Takeya Harada, Saitama-ken (JP); Toshiki Kobayashi, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/419,229

(22) Filed: Apr. 21, 2003

(65) Prior Publication Data

US 2003/0200946 A1 Oct. 30, 2003

(30) Foreign Application Priority Data

Apr. 24, 2002 (JP) ..... 2002/123040

(51) Int. Cl.[7] ..... F01L 1/18

(52) U.S. Cl. ..... 123/90.39; 123/90.44; 74/17; 411/10; 411/371.2; 411/536

(58) Field of Search ..... 123/90.39–90.47; 384/427; 411/10, 371.2, 372, 533, 536; 348/410; 74/17

(56) References Cited

U.S. PATENT DOCUMENTS 6,302,075 B1 * 10/2001 Krieg et al. ..... 123/90.41

* cited by examiner

*Primary Examiner*—Thomas Denion
*Assistant Examiner*—Kyle Riddle
(74) *Attorney, Agent, or Firm*—Arent Fox Kintner Plotkin & Kahn, PLLC

(57) ABSTRACT

There is provided a support device for a rocker arm, which is capable of suppressing deformation or wear of a washer, and greatly improving the working efficiency in assembling the washer to the rocker arm. The support device supports the rocker arm having a supported portion, for driving an engine valve of an internal combustion engine. A rocker shaft is supported between a pair of shaft holders arranged in the cylinder head, for pivotally supporting the rocker arm thereon via the supported portion. A washer has engaging pieces, and is attached to one of opposed ends of the supported portion of the rocker arm and one of the shaft holders, in a manner interposed between the opposed ends. The one of the opposed ends is formed with an annular engaging portion for having the washer engaged thereon via the engaging piece.

16 Claims, 10 Drawing Sheets

FIG10. B

SUPPORT DEVICE FOR ROCKER ARM

BACKGROUND OF THE INVENTION

1. Field of the Invention

This invention relates to a support device for a rocker arm used as a component of a valve mechanism for actuating an engine valve of an internal combustion engine.

2. Description of the Prior Art

A rocker arm of the above-mentioned kind has been conventionally proposed e.g. in Japanese Laid-Open Patent Publication (Kokai) No. 2000-303806, which includes a rocker shaft supported between a pair of supporting portions formed in a cylinder head, and a rocker arm pivotally movably supported on the rocker shaft via its supported portion. Further, a wave washer is mounted on one end of the supported portion of the rocker arm. The wave washer is comprised of a resilient annular portion bent in an outwardly curved manner, and a pair of engaging pieces extending inward from diametrically opposite portions of the annular portion. Each engaging piece has a predetermined bent shape and is resilient. On the other hand, the supported portion of the rocker arm has a pair of engaging holes formed at respective locations corresponding to the pair of engaging pieces. The wave washer has its engaging pieces precisely fitted in the engaging holes, respectively, and sandwich the supported portion of the rocker arm from opposite sides by the resilience of the engaging pieces, whereby the wave washer is unrotatably held on the supported portion of the rocker arm. The rocker shaft is inserted through the supported portion of the rocker arm and the annular portion of the wave washer, and in the assembled state of these members, the wave washer is sandwiched between the supported portion of the rocker arm and one of the aforementioned supporting portions, and the annular portion urges the rocker arm by the resilience thereof toward the other of the supporting portions, whereby the rattling of the rocker arm in the thrust direction is prevented.

In the conventional support device for the rocker arm, however, in assembling the wave washer to the rocker arm, it is necessary to circumferentially align the pair of engaging pieces of the wave washer with the pair of engaging holes of the rocker arm, respectively, which degrades the working efficiency in assembling the wave washer to the rocker arm. Further, since the engaging pieces of the wave washer are engaged with the engaging holes of the rocker arm, the wave washer is unrotatable with respect to the rocker arm, and further, since the wave washer is sandwiched between the rocker arm and the one of the supporting portions by the reactionary force of its own resilience, the rotation thereof is restricted. Therefore, as the rocker arm is pivotally moved, part of large load acting from the cam and the valve spring on the rocker arm acts on the wave washer. This makes the wave washer, particularly the engaging pieces, susceptible to deformation or wear. Further, since the supported portion of the rocker arm receiving large load from the cam and the valve spring is formed with the engaging holes, the resulting decrease in the cross-sectional area of the supported portion lowers the rigidity and strength of the supported portion.

SUMMARY OF THE INVENTION

It is an object of the invention to provide a support device for a rocker arm, which is capable of suppressing deformation or wear of a washer, and greatly improving the working efficiency in assembling the washer to the rocker arm.

To attain the above object, the invention provides a support device for supporting a rocker arm that includes a supported portion and actuates an engine valve of an internal combustion engine having a cylinder head, the support device comprising:

a plurality of shaft holders arranged in the cylinder head;

a rocker shaft supported by the plurality of shaft holders, for supporting the rocker arm thereon via the supported portion of the rocker arm between a pair of the shaft holders, such that the rocker arm can pivotally move thereabout; and a washer attached to one of respective opposed ends of the supported portion of the rocker arm and one of the shaft holders, in a manner interposed between the one of the opposed ends and the other of the opposed ends, the washer having an engaging piece, wherein the one of the opposed ends is formed with an annular engaging portion for having the washer engaged thereon via the engaging piece.

According to this support device for a rocker arm, a washer is attached to one of respective opposed ends of a supported portion of the rocker arm and one of shaft holders, in a manner interposed between the opposed ends. Further, the washer has an engaging piece, and the one of the opposed ends to which the washer is attached is formed with an annular engaging portion. The washer is latched or engaged on the supported portion of the rocker arm or the shaft holder by the engagement between the engaging piece and the annular engaging portion. Thus, the engaging piece of the washer is engaged with the annular engaging portion, which enables the washer to be assembled to the rocker arm or the shaft holder at any relative rotational angle thereto. This makes it absolutely unnecessary to carry out an operation for aligning the engaging piece with an engaging hole, which has been conventionally necessary, thereby greatly improving the working efficiency in assembling the washer to the associated component.

Preferably, the washer is engaged with the annular engaging portion via the engaging piece in a manner rotatable relative to the annular engaging portion.

According to this preferred embodiment, the rotation of the washer relative to the rocker arm or the shaft holder is permitted, whereby load applied from a cam or a valve spring via the rocker arm to the washer becomes very small, which makes it possible to suppress deformation or wear of the washer.

Preferably, the engaging piece comprises a plurality of engaging pieces arranged at intervals along a circumference of the washer, and the annular engaging portion is configured to be continuous along a circumference of the one of the opposed ends.

According to this preferred embodiment, the engaging piece of the washer comprises a plurality of engaging pieces circumferentially arranged, while the annular engaging portion is configured to be circumferentially continuous. This makes it possible to engage the plurality of engaging pieces on the annular engaging portion at any relative rotational angle without requiring any aligning work, and thereby maintain excellent working efficiency in assembling the washer to the rocker arm or the shaft holder. Further, since the engaging piece comprises a plurality of the engaging pieces, compared with a case in which the engaging piece is circumferentially continuous, it is easy to deform the engaging pieces, which further enhances working efficiency in assembling the washer to the rocker arm or the shaft holder. Moreover, when the washer is attached to the one of the opposed ends in a manner relatively rotatable, it is possible to reduce the rotational resistance of the washer.

Preferably, the annular engaging portion is formed by an annular protruding portion.

The supported portion of the rocker arm and the shaft holder are portions receiving large load from a cam or a valve spring when the rocker arm is pivotally moved, and therefore, it is preferred that they are configured to have as much rigidity and strength as possible. According to this preferred embodiment, the annular engaging portion for having the washer engaged thereon is configured as an annular protruding portion, and therefore, the resulting increase in cross-sectional area of the supported portion of the rocker arm or the shaft holder can make the rigidity and strength thereof much larger than in the case of the prior art in which engaging holes are formed therein.

Preferably, the washer is attached to the supported portion of the rocker arm, and at least part of the engaging piece is orthogonal to an axis of the rocker arm, and at the same time arranged at a location closer to a center of the supported portion than a plane passing on an outer end of an abutment portion of the rocker arm where the rocker arm is in abutment with the engine valve.

According to this preferred embodiment, at least part of the engaging piece is arranged by making effective use of space inside (not outward of) an abutment portion of the rocker arm where the rocker arm is in abutment with the engine valve. Therefore, the rocker arm can be made compact in size.

Preferably, the washer is attached to an end of the one of the shaft holders opposed to the rocker arm out of the respective opposed ends of the supported portion of the rocker arm and one of the shaft holders, and the annular protruding portion is formed at the end of the one of the shaft holders.

According to this preferred embodiment, since the shaft holder is formed with the annular protruding portion, it is possible to enhance not only the rigidity and strength of the shaft holders, but also the supporting rigidity of the rocker shaft supported by the shaft holders.

Preferably, the supported portion is formed with a projection corresponding to an overflow port used during casting of the rocker arm.

According to this preferred embodiment, the rigidity and strength of the supported portion can be further increased by the projection.

More preferably, the projection is formed on a flat surface of the supported portion radially inwardly offset from other peripheral portions of the supported portion.

According to this preferred embodiment, since the projection is formed on a flat surface of the supported portion radially inwardly offset from other peripheral portions of the supported portion, the engaging piece of the washer is prevented from being caught on the projection, thereby-ensuring rotation of the washer relative to the rocker arum.

Preferably, the washer comprises an annular portion having a central portion formed with a shaft hole through which the rocker shaft extends, and a plurality of the engaging pieces which extend from an outer periphery of the annular portion, and each of the engaging pieces comprises a perpendicular portion shortly extending perpendicularly from the annular portion and a curved portion having a semicircular shape and extending inwardly from the perpendicular portion.

More preferably, the washer is attached to the supported portion of the rocker arm, and the supported portion has an outer peripheral surface formed with an annular concave portion which is adjacent to the annular protruding portion and with which the curved portion of the engaging piece is engaged.

According to this preferred embodiment, the washer can be stably held on the rocker arm by the engagement of the annular concave portion and the curved portion of the engaging piece.

The above and other objects, features, and advantages of the invention will become more apparent from the following detailed description taken in conjunction with the accompanying drawings.

BRIEF DESCRIPTION OF THE DRAWINGS

FIG. 10B is a cross-sectional view taken on line B—B of FIG. 10A.

DETAILED DESCRIPTION OF PREFERRED EMBODIMENTS

Figure 1:
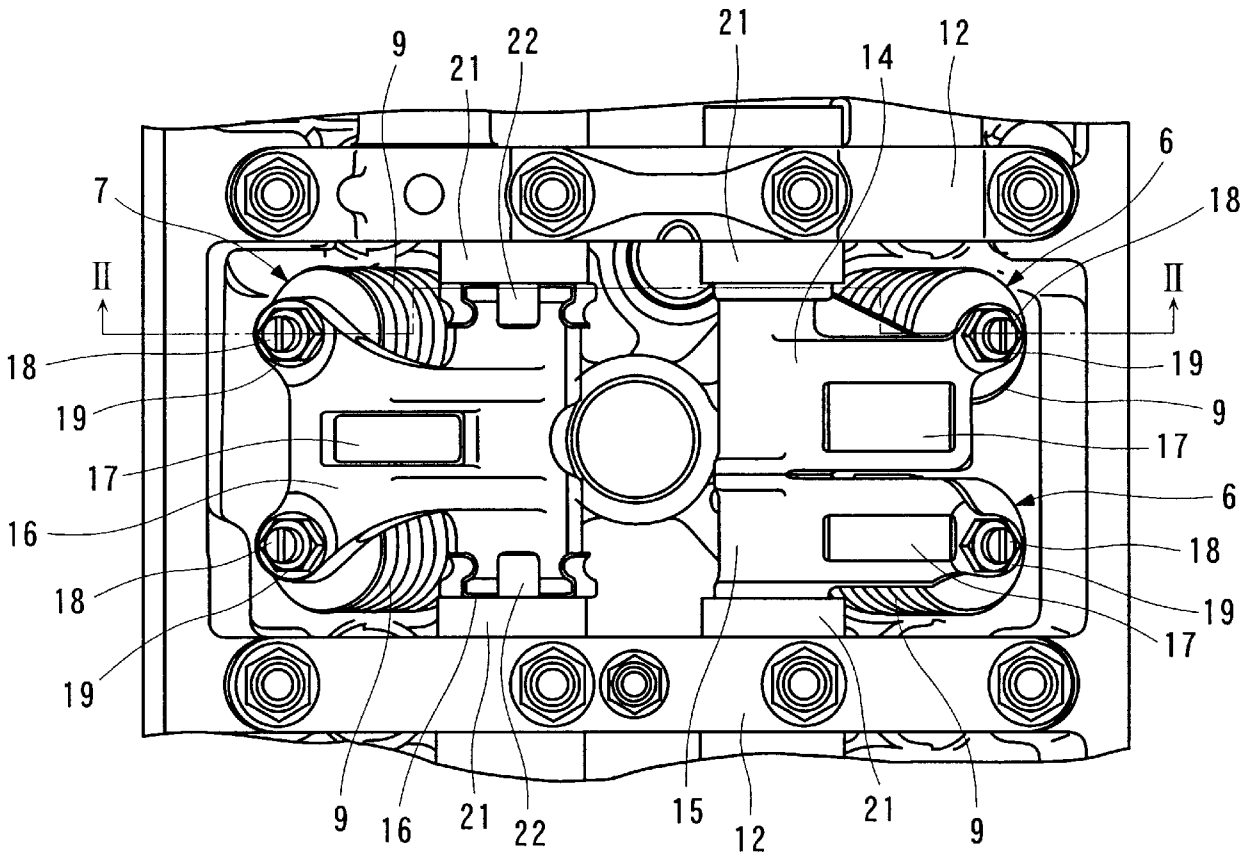
FIG. 1 is a fragmentary plan view showing the arrangement of a valve mechanism section of an internal combustion engine, including a support device for a rocker arm according to a first embodiment of the invention.
Figure 2:
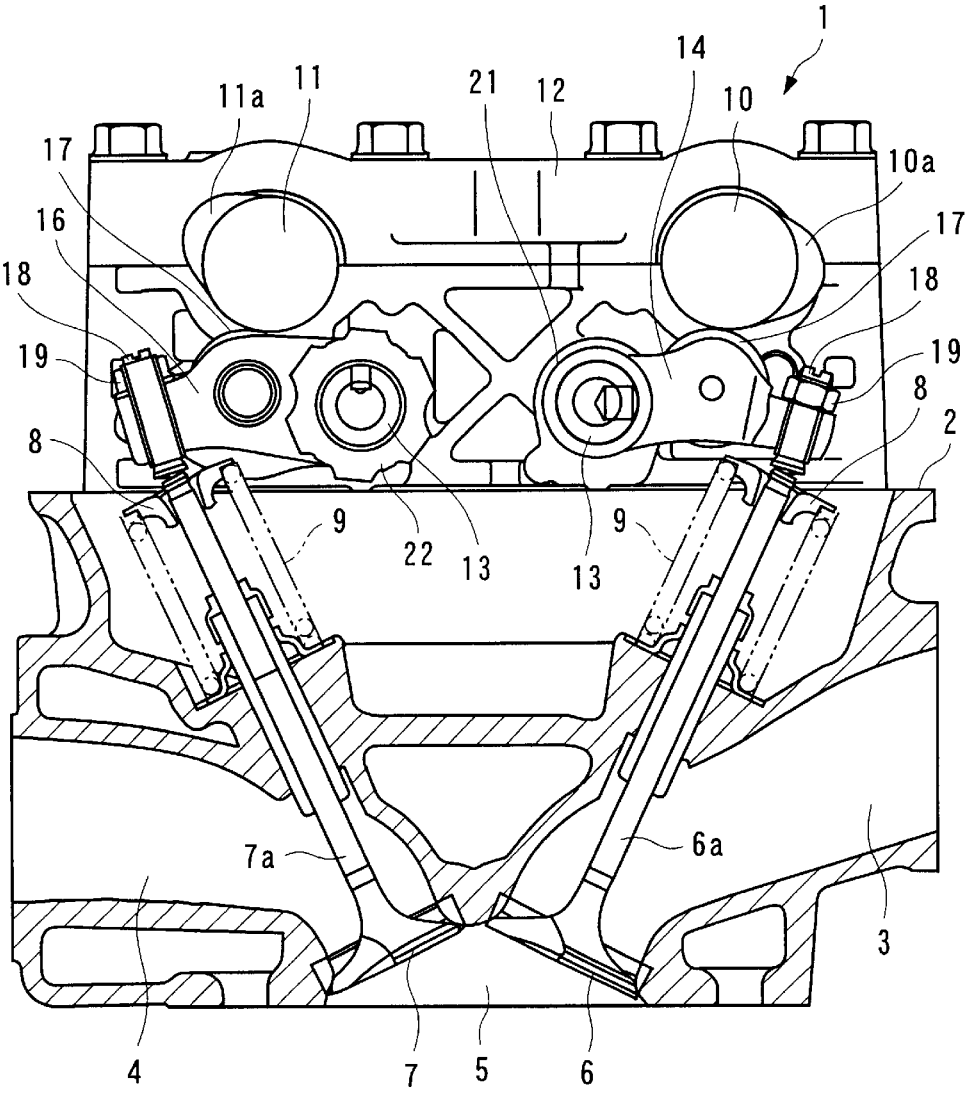
FIG. 2 is a cross-sectional view taken on line II—II of FIG. 1.

The present invention will now be described in detail with reference to the drawings showing preferred embodiments thereof. Referring first to FIGS. 1 and 2, there is schematically shown the arrangement of a valve mechanism section of an internal combustion engine, including a support device for a rocker arm, according to a first embodiment of the invention. The internal combustion engine (hereinafter simply referred to as "the engine") 1 is, for instance, a four-cylinder four-valve DOHC engine, which includes a cylinder head 2 having intake ports 3 and exhaust ports 4 formed therein. A set of intake ports 3 and exhaust ports 4 communicate with a corresponding one of combustion chambers 5, with intake valves 6 and exhaust valves 7 arranged as engine valves across respective communicating portions communicating between the intake ports 3 and the combustion chamber 5 and between the exhaust ports 4 and the combustion chamber 5. Each intake valve 6 and each exhaust valve 7 include valve stems 6*a*, 7*a* having valve springs 9 attached to upper portions thereof via retainers 8, respectively, such that the valve springs 9 urge the intake and exhaust valves 6, 7 upward in the valve-closing directions.

At respective locations above the intake valves 6 and the exhaust valves 7, there are arranged an intake camshaft 10 and an exhaust camshaft 11 in parallel with each other (not shown in FIG. 1). The intake and exhaust camshafts 10, 11 are held by camshaft holders 12 bolted to an upper portion of the cylinder head 2, and have two intake cams 10*a* (only one of which is shown in FIG. 2) and one exhaust cam 11*a* integrally formed therewith for each cylinder.

At respective locations below the intake and exhaust camshafts 10, 11, there are arranged intake and exhaust rocker shafts 13, 13 in parallel with each other. The intake rocker shaft 13 pivotally supports two intake rocker arms 14, 15 associated with the respective intake valves 6 for each cylinder, while the exhaust rocker shaft 13 pivotally supports one exhaust rocker arm 16 common to the two exhaust valves 7 for the cylinder. The above rocker arms 14 to 16 have cam rollers 17 arranged in respective intermediate portions thereof such that the intake cams 10*a* and exhaust cam 11*a* associated with the rocker arms 14 to 16 are in sliding contact therewith. Further, each of the intake rocker arms 14, 15 has one adjuster screw 18 fixed to an end thereof by a locknut 19, while the exhaust rocker arm 16 has two adjuster screws 18, 18 fixed to an end thereof by locknuts 19, respectively. The adjuster screws 18 are in abutment with respective upper ends of the valve stems 6*a*, 7*a* of the intake valves 6 and exhaust valves 7 associated therewith.

As the intake and exhaust camshafts 10, 11 rotate in synchronism with rotation of a crankshaft, not shown, the intake cams 10*a* and exhaust cam 11*a* drive the rocker arms 14 to 16 associated therewith, so that the rocker arms 14 to 16 are pivotally moved about the rocker shafts 13 to thereby urge the valve stems 6*a*, 7*a* via the adjuster screws 18 against the respective urging forces of the valve springs 9, causing the intake valves 6 and the exhaust valves 7 to be opened and closed.

Next, the configurations of the rocker arm and the support device therefor according to the present invention will be described in detail by taking the exhaust rocker arm 16 (hereinafter simply referred to as "the rocker arm 16") as an example. As shown in FIGS. 1 and 2, the cylinder head 2 has a lot of exhaust-side shaft holders 21, 21 . . . (only two of which are shown in FIG. 1) formed at locations below and inward of the exhaust camshaft 11 such that they are arranged side by side in a row parallel with the camshaft 11. The shaft holders 21 are made e.g. of cast aluminum, and the rocker shaft 13 is held by the shaft holders 21.

The rocker shaft 13 extends through respective supported portions 23 (only one of which is shown), referred to hereinafter, of the rocker arms 16 for the cylinders, for pivotally supporting the supported portions 23 thereon. Each supported portion 23 is arranged in a state interposed between two associated ones of the shaft holders 21, 21. Each rocker arm 16 is also formed e.g. of cast aluminum. Further, the supported portion 23 of the rocker arm 16 has washers 22, 22 attached to opposite ends thereof. The washers 22, 22 serve as spacers for preventing the relatively soft rocker arm 16 and shaft holders 21, 21 from adhering to each other by seizure which might be caused if they were in direct contact with each other. The washers 22, 22 are formed e.g. of stainless steel.

Figure 3:
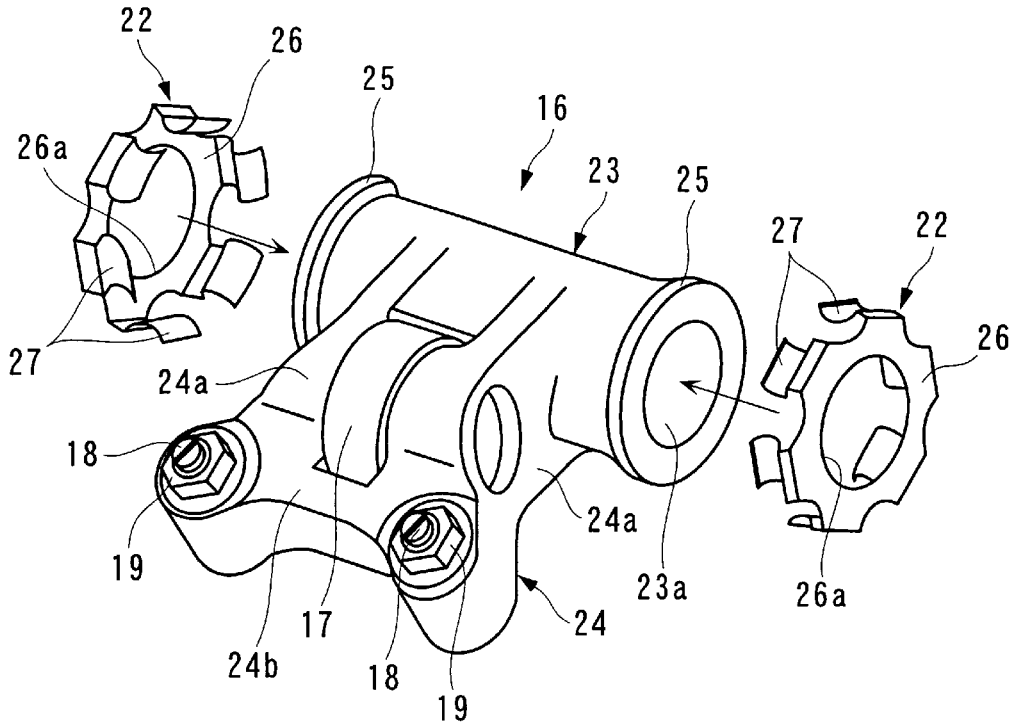
FIG. 3 is a perspective view showing the configurations of a rocker arm and washers, which is useful in explaining how the washers are attached to the rocker arm.
Figure 4A:
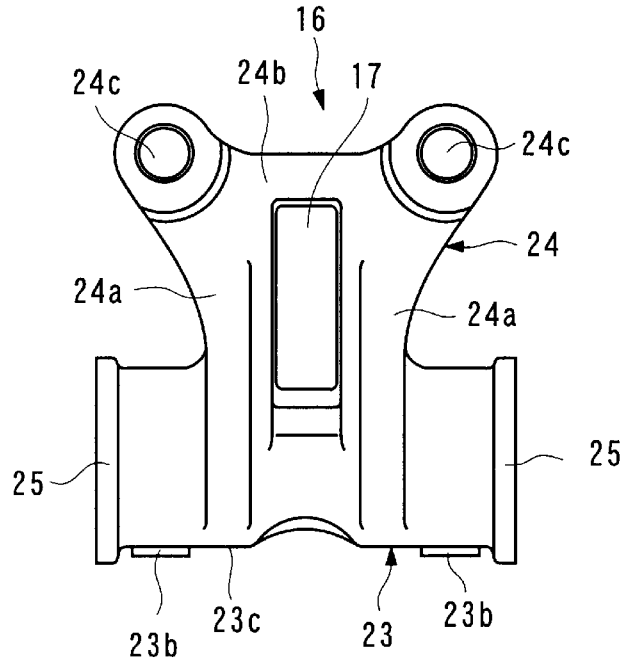
FIG. 4A is a plan view of the rocker arm.
Figure 4B:
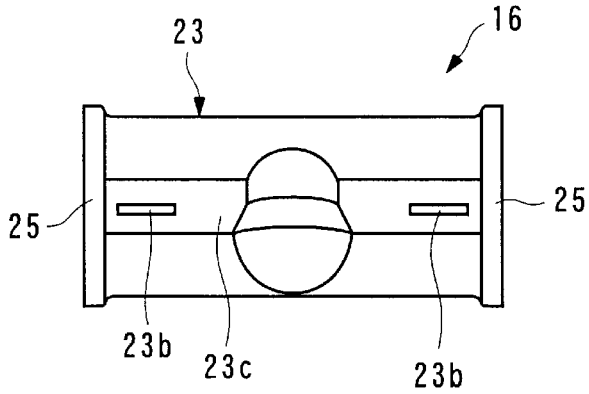
FIG. 4B is a front view of the rocker arm.

Referring to FIGS. 3 and 4A, 4B, the rocker arm 16 includes the above-mentioned supported portion 23, and an arm portion 24 extending from the supported portion 23 in a direction orthogonal to the axis of the supported portion, as integral parts thereof. The supported portion 23 has a shape of a relatively thick hollow cylinder with a shaft hole 23*a* formed therethrough. The rocker shaft 13 is inserted through the shaft hole 23*a*. Further, the opposite ends of the supported portion 23 are formed to have flat end faces and circumferentially continuous annular protruding portions 25, 25, for having the washers 22, 22 fitted thereon, respectively, which will be described hereinafter.

The arm portion 24 is comprised of two forked portions 24*a*, 24*a* extending from the supported portion 23 with a gap therebetween, and a connecting portion 24*b* connecting between distal ends of the forked portions. The forked portions 24*a*, 24*a* extend up to intermediate portions thereof in parallel with each other, and the above-mentioned cam roller 17 is rotatably fitted in the gap therebetween in a manner slightly projecting upward. Further, from the intermediate portions, the forked portions 24*a*, 24*a* further extend obliquely more apart, and the distal ends thereof, that is, opposite ends of the connecting portion 24*b*, are formed with screw holes 24*c*, 24*c* for screwing the above-mentioned adjuster screws 18 therein.

It should be noted that the screw holes 24*c*, 24*c* correspond to sprues used in casting the rocker arm 16, and opposite end portions of the outer peripheral surface of the supported portion 23, at respective locations opposite to the screw holes 24*c*, 24*c* correspond to overflow ports. As shown in FIGS. 4A and 4B, the opposite end portions are formed with protrusions 23*b*, 23*b* left as remains of the overflow ports. Further, an outer peripheral portion of the supported portion 23, on which the protrusions 23*b*, 23*b* are formed, is formed as a flat surface 23*c* radially inwardly offset from the other peripheral portions of the supported portion 23 such that the protrusions 23*b* do not obstruct the washers 22, 22 attached to the opposite ends of the supported portion 23.

Figure 5A:
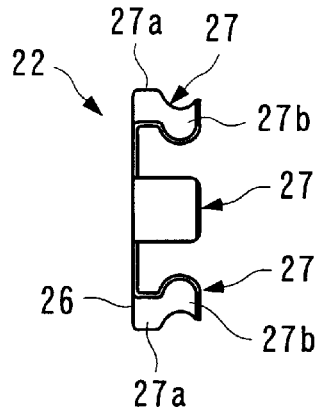
FIG. 5A is a side view of a washer.
Figure 5B:
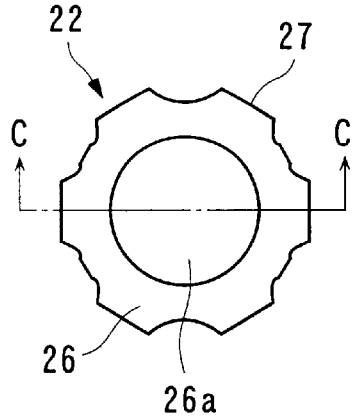
FIG. 5B is a front view of the washer.
Figure 5C:
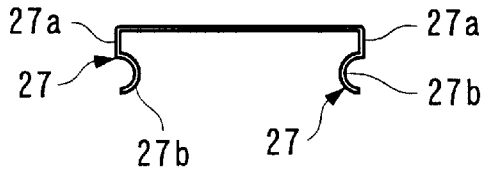
FIG. 5C is a cross-sectional view taken on line C—C of FIG. 5B.

The washers 22, 22 are formed of stainless steel or the like, as described hereinabove. As shown in FIGS. 5A to 5C, each of the washers 22, 22 is comprised of an annular portion 26, and a plurality of (six in the case of the illustrated example) engaging pieces 27 extending from an outer periphery of the annular portion 26. The annular portion 26 is formed to be flat, with a shaft hole 26*a* formed through a central portion thereof, for having the rocker shaft 13 inserted therethrough. Further, the six engaging pieces 27 are arranged along the circumference of the annular portion 26, at equally-spaced intervals, i.e. every 60 degrees about the center of the annular portion 26. As shown in FIG. 5C, each engaging piece 27 is comprised of a perpendicular portion 27*a* extending perpendicularly from the annular portion 26 to a predetermined short length, and a substantially semicircular curved portion 27*b* extending radially inward from the perpendicular portion 27*a*.

Figure 6A:
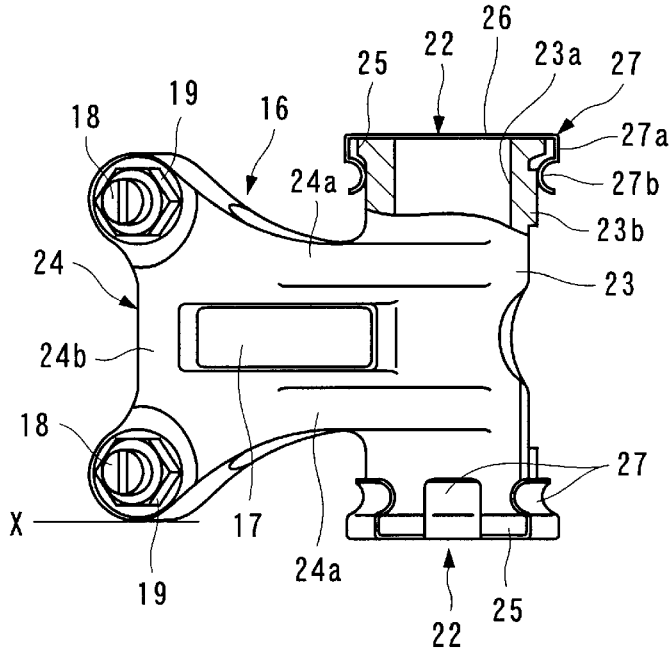
FIG. 6A is a partially-cutaway plan view of the rocker arm with the washers attached thereto.
Figure 6B:
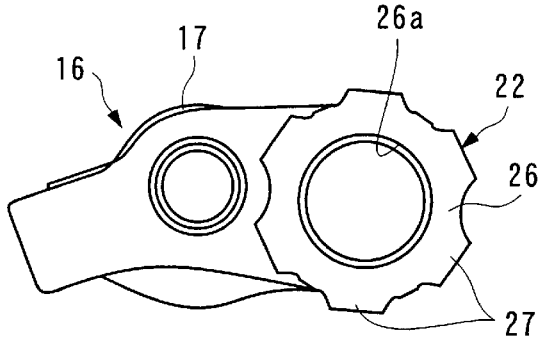
FIG. 6B is a front view of the rocker arm with the washers attached thereto.

The washers 22 configured as above are fitted on the respective ends of the supported portion 23 of the rocker arm 16, as shown in FIG. 3 and FIGS. 6A and 6B. In this state, as shown in FIG. 6A, the perpendicular portion 27*a* of each engaging piece 27 of the washer 22 is engaged with the annular protruding portion 25 of the supported portion 23 with a small gap, and the curved portion 27*b* is in abutment with the outer periphery of the supported portion 23. This causes the washers 22 to be engaged on the supported portion 23 of the rocker arm 16 in a manner rotatable relative to the supported portion 23. In the present embodiment, as described hereinbefore, the protrusions 23*b* of the supported portion 23 are formed on the flat surface 23*c* radially inwardly offset, so that the protrusions 23*b* are prevented from catching the washers 22 so as not to obstruct the relative rotation of the washers 22. Further, as shown in FIG. 6A, each washer 22 is mounted such that part of each engaging piece 27 thereof is orthogonal to the axis of the rocker arm 16, and at the same time arranged at a location closer to a center of the supported portion 23 than a plane X passing on an outer end of the connecting portion 24*b* of the arm portion 24.

The rocker arm 16 after having the washers 22, 22 attached thereto, as described above, is assembled between the shaft holders 21, 21, and the rocker shaft 13 is inserted through the shaft holes 23*a*, 26*a* of the rocker arm 16 and the washers 22, whereby the rocker arm 16 is pivotally supported on the rocker shaft 13. In this state, each washer 22 is held in a state rotatable with respect to the supported portion 23 of the rocker arm 16, and interposed between the supported portion 23 and the shaft holder 21 in a state in which the washer 23 is in abutment with the shaft holder 21 opposed thereto. This makes it possible to prevent the supported portion 23 and the shaft holder 21 from adhering to each other by seizure which might be caused if they were in direct contact with each other.

As described hereinabove, according to the present embodiment, the washers 22 are rotatably attached to the rocker arm 16 through the engagement of the engaging pieces 27 thereof and the annular protruding portions 25 of the rocker arm 16. Therefore, the washers 22 are permitted to rotate with respect to the rocker arm 16, whereby when the rocker arm 16 is pivotally moved, load applied to the washers 22 from the exhaust cam 11*a* and the valve springs 9 via the rocker arm 16 becomes very small. As a result, it is possible to prevent deformation and wear of the washers 22.

Further, since each washer 22 is formed with the plurality of engaging pieces 27, and an engaging portion of the rocker arm 16 for having the engaging pieces 27 engaged therewith is formed by the circumferentially continuous annular protruding portion 25, it is possible to engage the engaging pieces 27 of the washer 22 with the annular protruding portion 25 at any relative rotational angle when the washer 22 is attached to the rocker arm 16. This makes it absolutely unnecessary to carry out an operation for aligning engaging pieces with engaging holes, which has been conventionally necessary, whereby the working efficiency in assembling the washers 22 to the rocker arm 16 can be greatly enhanced.

Further, the annular protruding portions 25 are formed on the supported portion 23 as portions protruding therefrom, so that when compared with the conventional case of engaging holes being formed in the supported portion 23, an increase in cross-sectional area of the supported portion due to the provision of the protruding portions 25 makes it possible to largely enhance the rigidity and strength of the supported portion 23 which receives large load from the exhaust cam 11*a* and the like when the rocker arm 16 is pivotally moved. Further, as described above, since the supported portion 23 is formed with the protrusions 23*b*, 23*b* corresponding to overflow ports used in casting the rocker arm 16, it is possible to further enhance the rigidity and strength of the supported portion 23 by the protrusions 23*b*, 23*b*. Further, since the protrusions 23*b*, 23*b* are formed on the flat surface 23*c* radially inwardly offset from the other peripheral portions of the supported portion 23, the engaging pieces 27 of the washers 22 are prevented from being caught on the protrusions 23*b*, which positively permits the rotation of the washers 22 relative to the rocker arm 16.

Further, as described hereinabove, part of each engaging piece 27 of the washer 22 is arranged at a location closer to the center of the supported portion 23 than the plane X passing on the outer end of the connecting portion 24*b* of the rocker arm 16, i.e. in a space inside (not outward of) an abutment portion of the rocker arm 16 where the rocker arm 16 is in abutment with the exhaust valve 7. This enables effective use of the space, thereby making it possible to make the rocker arm 16 compact in size in an axial direction. Further, differently from a conventional bent annular portion, the annular portion of the washer 22 is formed to be flat, whereby the rocker arm 16 can be made more compact in size in the axial direction.

Figure 7:
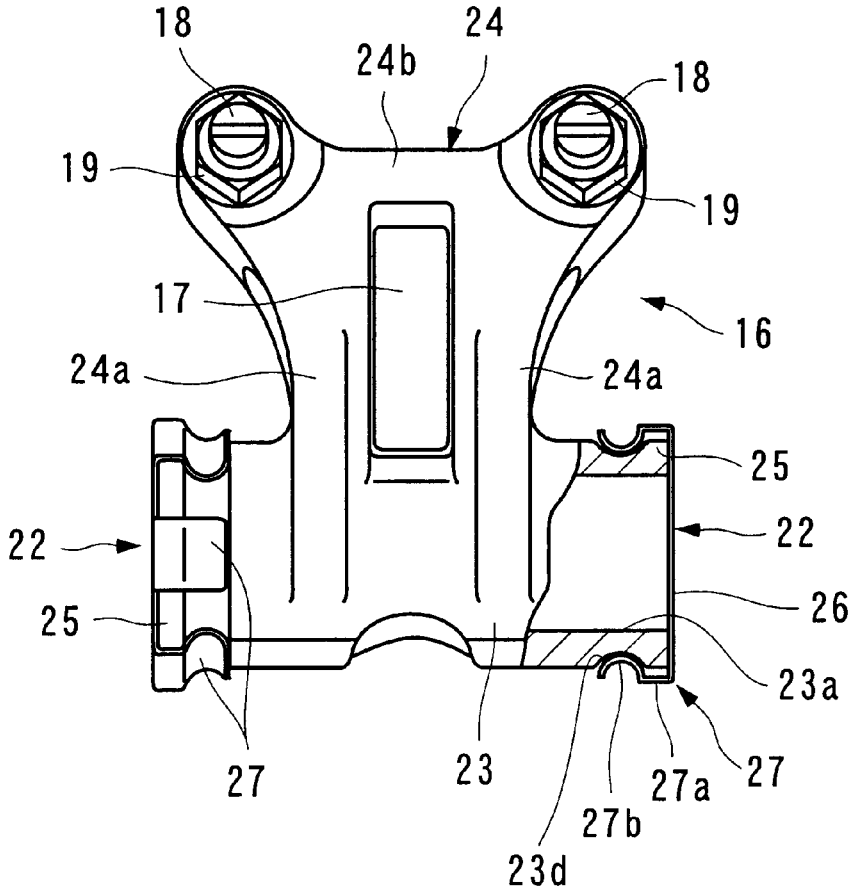
FIG. 7 is a partially-cutaway plan view similar to FIG. 6A, which shows a variation of the rocker arm.

FIG. 7 shows a variation of the rocker arm 16. This rocker arm 16 has annular concave portions 23*d* formed in an outer peripheral surface of the supported portion 23 at a location adjacent to the annular protruding portions 25. The curved portions 27*b* of the engaging pieces 27 of the washers 22 are engaged with the annular concave portions 23*d*. Further, the protrusions 23*b* of the support device according to the first embodiment are omitted. Therefore, compared with the first embodiment, although this variation is slightly reduced in the rigidity or strength of the supported portion 23 due to the provision of the annular concave portions 23*d*, it is possible to stably hold the washers 22 on the rocker arm 16 by engaging the annular concave portions 23*d* and the corresponding curved portions 27*b* of the engaging pieces 27 with each other.

Figure 8:
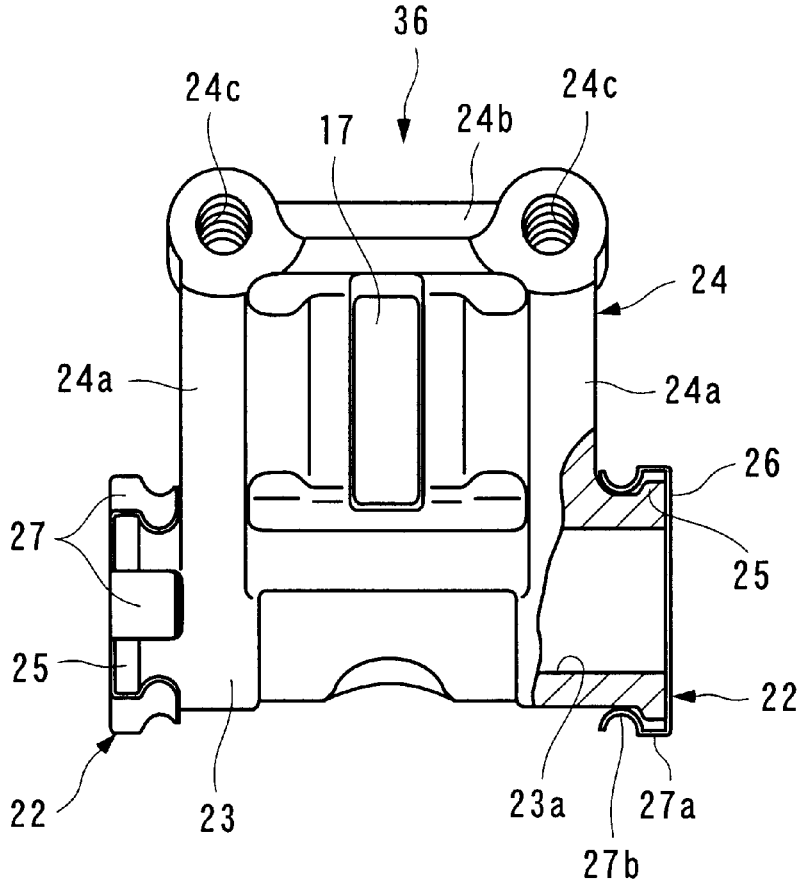
FIG. 8 is a partially-cutaway plan view similar to the FIG. 6A, which shows another variation of the rocker arm.

FIG. 8 shows another variation of the rocker arm 16. That is, this rocker arm 36 is of a type having a different shape from that of the rocker arm 16 described hereinabove. More specifically, in this rocker arm 36, the two forked portions 24*a*, 24*a* of the arm portion 24 extend up to the connecting portion 24*b* at the distal ends of the arm portion 24 in parallel with each other. The other configurations are similar to those of the rocker arm 16. Therefore, in this variation, although the axial length of the rocker arm 36 is slightly larger than that of the rocker arm 16, it is possible to obtain the same advantageous effects as provided by the above embodiment in the other respects. Additionally, the annular protruding portions 25 are formed outward of the forked portions 24*a*, 24*a* of the arm portion 24, which extend in parallel with each other. This can largely enhance the rigidity and strength of the rocker arm 36.

Figure 9:
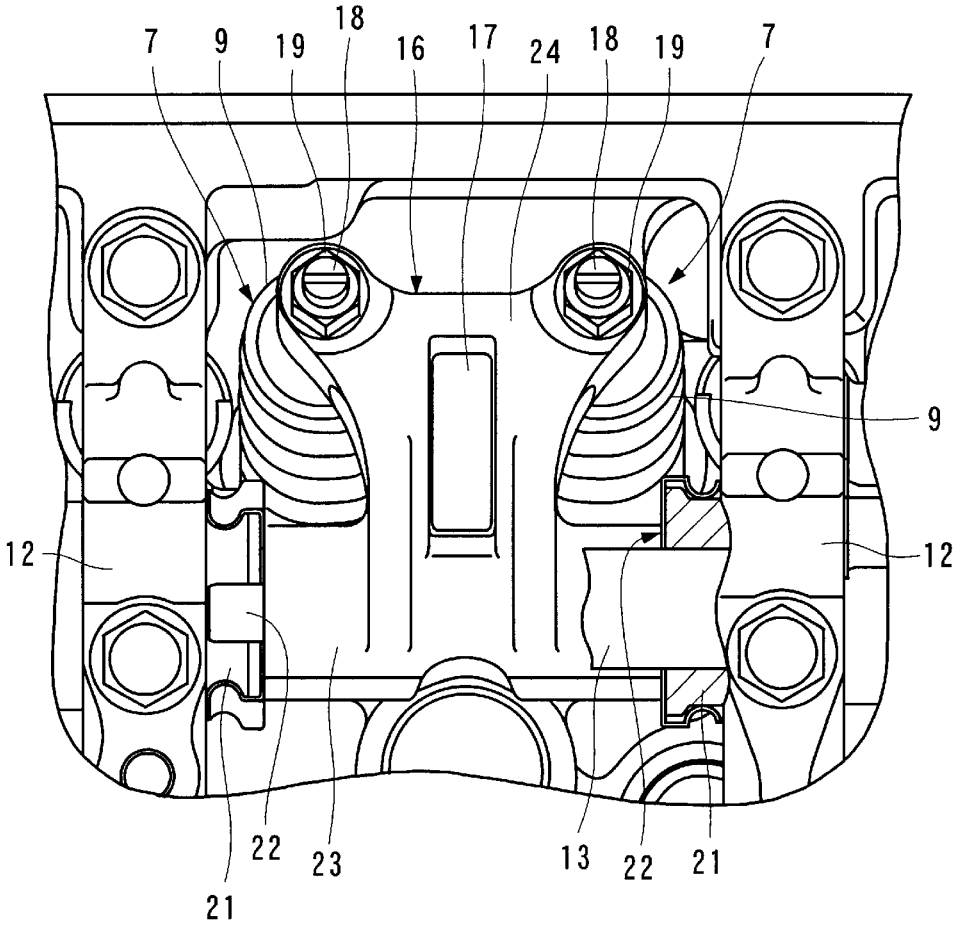
FIG. 9 is a fragmentary plan view similar to the FIG. 1, which shows a second embodiment of the invention.

FIG. 9 shows a second embodiment of the invention. In the second embodiment, the washers 22 are attached not to the rocker arms 16 but to the shaft holders 21. To this end, each shaft holder 21 has an end formed with an annular protruding portion 45 similar to the annular protruding portion 25 of the rocker arm 16 according to the first embodiment. The engaging pieces 27 of the washers 22 are rotatably engaged with the annular protruding portions 45. Therefore, in the present embodiment, the washers 22 are permitted to rotate with respect to the shaft holders 21, whereby similarly to the first embodiment, when the rocker arm 16 is pivotally moved, load applied to the washers 22 can be made very small to prevent deformation and wear of the washers 22. Further, since the shaft holders 21 are formed with the annular protruding portions 45, it is possible to increase not only the rigidity and strength of the shaft holders 21 but also the supporting rigidity of the rocker shaft 13 supported by the shaft holders 21.

Figure 10A:
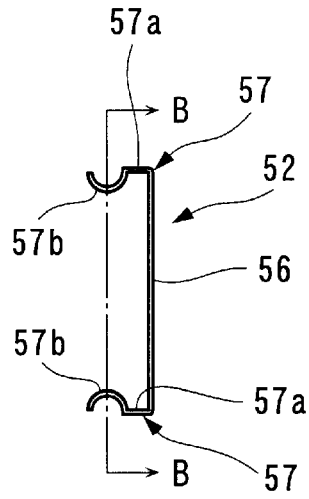
FIG. 10A is a sectional side elevation of a variation of the washer.
Figure 10A:
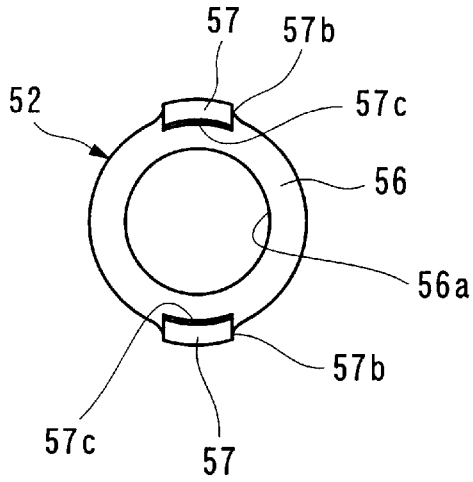

FIGS. 10A and 10B show a variation of the washer. The washer 52 includes an annular portion 56 in the form of a flat plate having a shaft hole 56*a* formed therethrough, and only two engaging pieces 57 are formed on the annular portion 56 at diametrically opposite locations. Similarly to the engaging pieces 27 of the washers 22, each engaging piece 57 is comprised of a perpendicular portion 57*a* shortly extending perpendicularly from the annular portion 56, and a substantially semicircular curved portion 57*b* extending inward from the perpendicular portion 57*a*. Further, as shown in FIG. 10B, the curved portion 57*b* is also curved circumferentially in a manner concentric with the annular portion 56, and the curved inner surface forms an aligning surface 57*c*.

As a result, according to the washer 52, if a force is applied thereto in the direction of removing the same from the rocker arm 16 in the state of the washer 52 attached to the rocker arm 16, the aligning function of the curved aligning surface 57*c* works, whereby the washer 52 can be stably held on the rocker arm 16. Further, since it is required to form only two engaging pieces 57, the machinability of the washers 52 can be increased.

It should be noted the present invention can be implemented in various forms without being limited to the above-described embodiments. For instance, although the above embodiments are described, by way of example, on the cases where the present invention is applied to the exhaust rocker arm 16, it goes without saying that the present invention may be applied to the intake rocker arms 14, 15. Further, although in the above embodiments, the annular portions 26, 56 of the washers 22, 52 are in the form of a flat plate, they may be in the form of an elastic curved plate. This makes it possible to urge the rocker arm 16 toward the shaft holder 21 on the opposite side by the elasticity of the annular portion, whereby it is possible to prevent the rocker arm 16 from being unstable or rattling.

Further, although in the above embodiments, the annular protruding portions 25, 45 are formed as the engaging portion of the rocker arm 16 or the shaft holder 21, for having the engaging pieces of the washer engaged therewith, this is not limitative, but an annular groove may be formed in place of the annular protruding portion. Further, the number of the engaging pieces of the washers may be any number other than six or two exemplified in the above embodiments, e.g. four as a matter of course, so long as the engaging pieces can be positively held on the rocker arm or the like.

It is further understood by those skilled in the art that the foregoing are preferred embodiments of the invention, and that various changes and modifications may be made without departing from the spirit and scope thereof.

What is claimed is:

1. A support device for supporting a rocker arm that includes a supported portion and actuates an engine valve of an internal combustion engine having a cylinder head, the support device comprising:

a plurality of shaft holders arranged in the cylinder head;

a rocker shaft supported by said plurality of shaft holders, for supporting the rocker arm thereon via the supported portion of the rocker arm between a pair of said shaft holders, such that the rocker arm can pivotally move thereabout; and a washer attached to one of respective opposed ends of the supported portion of the rocker arm and one of said shaft holders, in a manner interposed between the opposed ends, said washer having an engaging piece, wherein the one of the opposed ends is formed with an annular engaging portion for having said washer engaged thereon via said engaging piece.

2. A support device according to claim 1, wherein said washer is engaged with said annular engaging portion via said engaging piece in a manner rotatable relative to said annular engaging portion.

3. A support device according to claim 1, wherein said engaging piece comprises a plurality of engaging pieces arranged at intervals along a circumference of said washer, and wherein said annular engaging portion is configured to be continuous along a circumference of the one of the opposed ends.

4. A support device according to claim 2, wherein said engaging piece comprises a plurality of engaging pieces arranged at intervals along a circumference of said washer, and wherein said annular engaging portion is configured to be continuous along a circumference of the one of the opposed ends.

5. A support device according to claim 1, wherein said annular engaging portion is formed by an annular protruding portion.

6. A support device according to claim 2, wherein said annular engaging portion is formed by an annular protruding portion.

7. A support device according to claim 3, wherein said annular engaging portion is formed by an annular protruding portion.

8. A support device according to claim 1, wherein said washer is attached to the supported portion of the rocker arm, and wherein at least part of said engaging piece is orthogonal to an axis of the rocker arm, and at the same time arranged at a location closer to a center of the supported portion than a plane passing on an outer end of an abutment portion of the rocker arm where the rocker arm is in abutment with the engine valve.

9. A support device according to claim 2, wherein said washer is attached to the supported portion of the rocker arm, and wherein at least part of said engaging piece is orthogonal to an axis of the rocker arm, and at the same time arranged at a location closer to a center of the supported portion than a plane passing on an outer end of an abutment portion of the rocker arm where the rocker arm is in abutment with the engine valve.

10. A support device according to claim 3, wherein said washer is attached to the supported portion of the rocker arm, and wherein at least part of said engaging piece is orthogonal to an axis of the rocker arm, and at the same time arranged at a location closer to a center of the supported portion than a plane passing on an outer end of an abutment portion of the rocker arm where the rocker arm is in abutment with the engine valve.

11. A support device according to claim 5, wherein said washer is attached to the supported portion of the rocker arm, and wherein at least part of said engaging piece is orthogonal to an axis of the rocker arm, and at the same time arranged at a location closer to a center of the supported portion than a plane passing on an outer end of an abutment portion of the rocker arm where the rocker arm is in abutment with the engine valve.

12. A support device according to claim 1, wherein said washer is attached to an end of the one of said shaft holders opposed to the rocker arm out of the respective opposed ends of the supported portion of the rocker arm and one of said shaft holders, and wherein said annular protruding portion is formed at said end of the one of said shaft holders.

13. A support device according to claim 1, wherein the supported portion is formed with a projection corresponding to an overflow port used during casting of said rocker arm.

14. A support device according to claim 13, wherein said projection is formed on a flat surface of the supported portion radially inwardly offset from other peripheral portions of the supported portion.

15. A support device according to claim 1, wherein said washer comprises an annular portion having a central portion formed with a shaft hole through which said rocker shaft extends, and a plurality of said engaging pieces which extend from an outer periphery of said annular portion, and wherein each of said engaging pieces comprises a perpendicular portion shortly extending perpendicularly from said annular portion and a curved portion having a semi-circular shape and extending inwardly from said perpendicular portion.

16. A support device according to claim 15, wherein said washer is attached to the supported portion of the rocker arm, and wherein the supported portion has an outer peripheral surface formed with an annular concave portion which is adjacent to said annular protruding portion and with which said curved portion of said engaging piece is engaged.

* * * * *